United States Patent [19]

Kupiec, Sr.

[11] 4,320,794

[45] Mar. 23, 1982

[54] KUPIEC'S MOBILE INGOT EXTRACTOR

[75] Inventor: Edward J. Kupiec, Sr., 724 Lafayette St., Utica, N.Y. 13502

[73] Assignees: Edward J. Kupiec, Sr.; Helen Kupiec; Edward J. Kupiec, Jr., all of Utica; Robert J. Kupiec, Barneveld; Peter M. Kupiec, Barneveld; Christopher P. Kupiec, Barneveld; Roberta H. Wessendorf, Guilderland, all of N.Y. ; a part interest

[21] Appl. No.: 254,107

[22] Filed: Apr. 14, 1981

[51] Int. Cl.[3] ..... B22D 29/06

[52] U.S. Cl. ..... 164/406; 164/405

[58] Field of Search ..... 164/401, 405, 406, 408, 164/404; 29/252

[56] References Cited

U.S. PATENT DOCUMENTS

| | | | |
|---|---|---|---|
| 395,330 | 1/1889 | Jones | 164/405 |
| 418,999 | 1/1890 | Wellman | 164/405 |
| 1,533,560 | 4/1925 | Linder | 29/252 |
| 1,760,989 | 6/1930 | Lewis | 29/252 |
| 2,622,315 | 12/1952 | Loveland | 29/252 |

FOREIGN PATENT DOCUMENTS

| | | | |
|---|---|---|---|
| 48917 | 12/1964 | Poland | 164/405 |

*Primary Examiner*—Gus T. Hampilos

*Attorney, Agent, or Firm*—Walter F. Wessendorf, Jr.

[57] ABSTRACT

Discloses a self-contained and non-polluting mobile ingot extractor having a wheeled undercarriage and drawbar frame with a hitch for towing same. The extractor has longitudinal frame members carrying cross-members which carry stops and a hydraulic ram. The longitudinal axis of the stuck ingot and its mold is horizontally disposed between said stops and ram head of the hydraulic ram. A low volume-high pressure hydraulic pump exerts force through the ram head upon the stuck ingot to remove same from its mold.

6 Claims, 6 Drawing Figures

FIG. 4
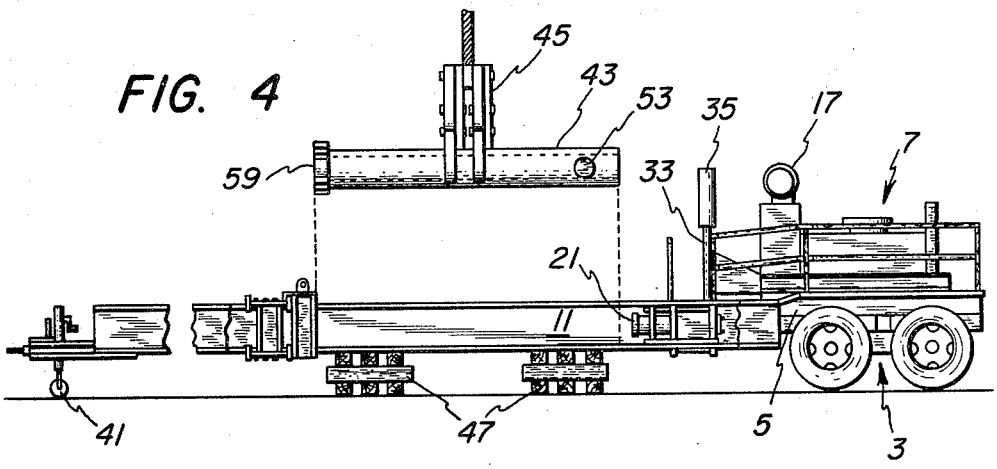
FIG. 5
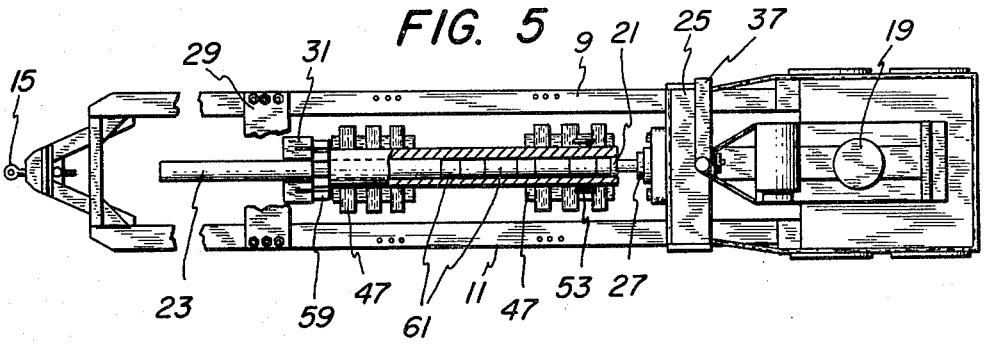
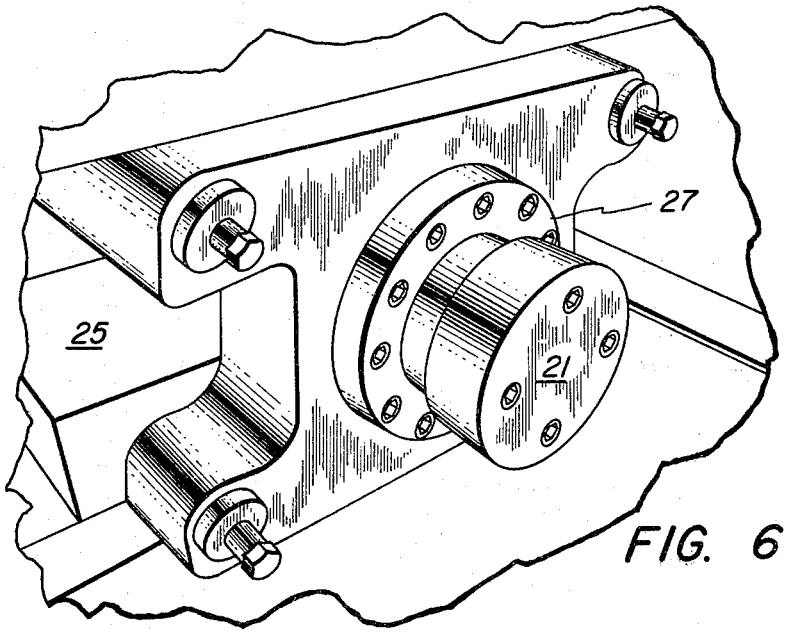
FIG. 6

KUPIEC'S MOBILE INGOT EXTRACTOR

BACKGROUND OF THE INVENTION

Technical Field

This invention relates to the problem and technology involved in removing ingots of special or exotic metals from there molds.

Before the molten special or exotic metal for use in the aerospace industry is poured into a mold to form an ingot, the mold is coated with a solution to help prevent such molten metal from eating into the mold's inside wall. Nevertheless, the molten ingot burns into the mold wall sometimes despite the prior application of such preventive solution or coating. This presents a problem in the subsequent removal of the ingot, compounded by the fact that the mold is of uniform internal diameter because of subsequent operations that must be performed upon such ingot, such as rolling, etc. With the price of such metal ranging to $25.00 per pound, a 10-ton ingot is worth $500,000. The discussed problems of the ingot sticking in its mold has presented a factor of around 1 in 8 to 10 ingots sticking in their molds, and such that same could not be removed from their molds under any application of prior-art technology. In such instances of ingots that could not be removed from their molds, the only prior-art solution to removing such stuck ingots has been to physically destroy the molds to recover the ingots. Physically destroying such molds to remove their stuck ingots is expensive, as well as time consuming, because the molds for such special or exotic metals can be in the price range of $10,000 depending upon size.

Accordingly, the object of the invention is to contribute to the solution of the discussed problems of the art by providing a self-contained, non-polluting, mobile ingot extractor, that can be hauled or towed into a steel plant when the need arises, to remove stuck ingots of special or exotic metals from their molds.

SUMMARY OF THE INVENTION

In accordance with the invention, there is provided a mobile ingot extractor comprising a wheeled trailer and its power unit. The mold is disposed in mounting position relative to the extractor's longitudinal frame members and coaxial with the power unit's reciprocating ram and ram head. The ram is appropriately operated for its ram head to engage and effect the removal of the stuck ingot from its mold that has been prepared prior thereto for such operation.

BRIEF DESCRIPTION OF THE DRAWINGS

This object and other objects of the invention should be discerned and appreciated by reference to the drawings wherein like reference numerals refer to similar parts throughout the several views in which:

FIG. 4 is a side view of the invention;

FIG. 5 is a top view of the invention; and

FIG. 6 is an isometric view showing the ram mounted on a fixed cross-bracket.

DESCRIPTION OF THE PREFERRED EMBODIMENT

Figure 1:
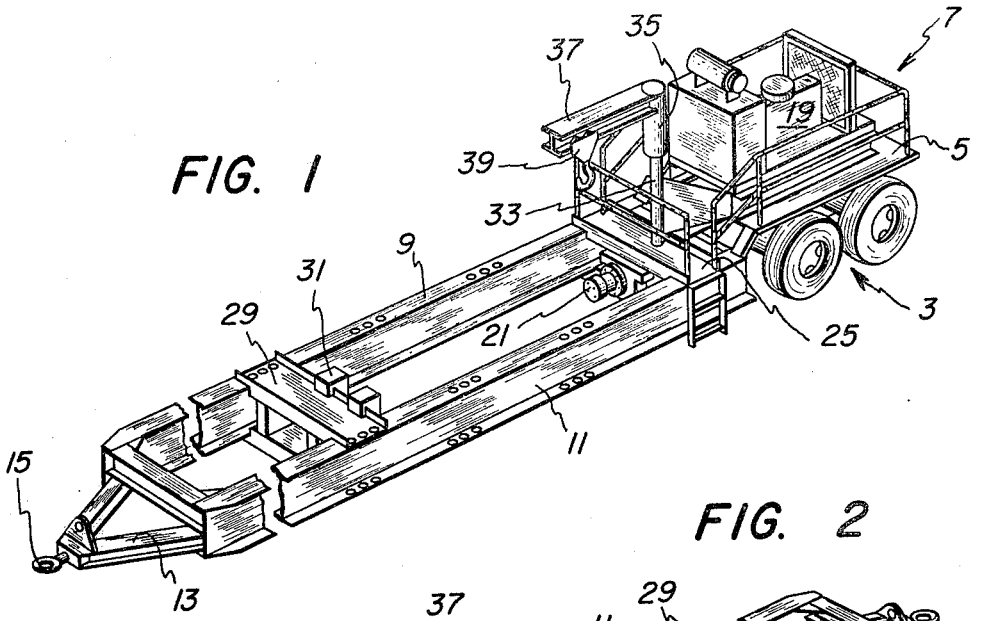
FIG. 1 is an isometric view of the invention taken in one direction.
Figure 2:
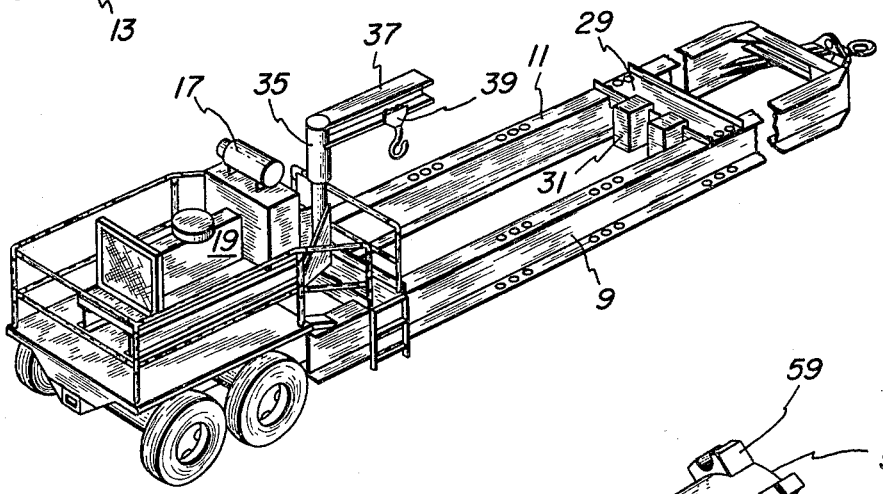
FIG. 2 is an isometric view of the invention taken in another direction.
Figure 3:
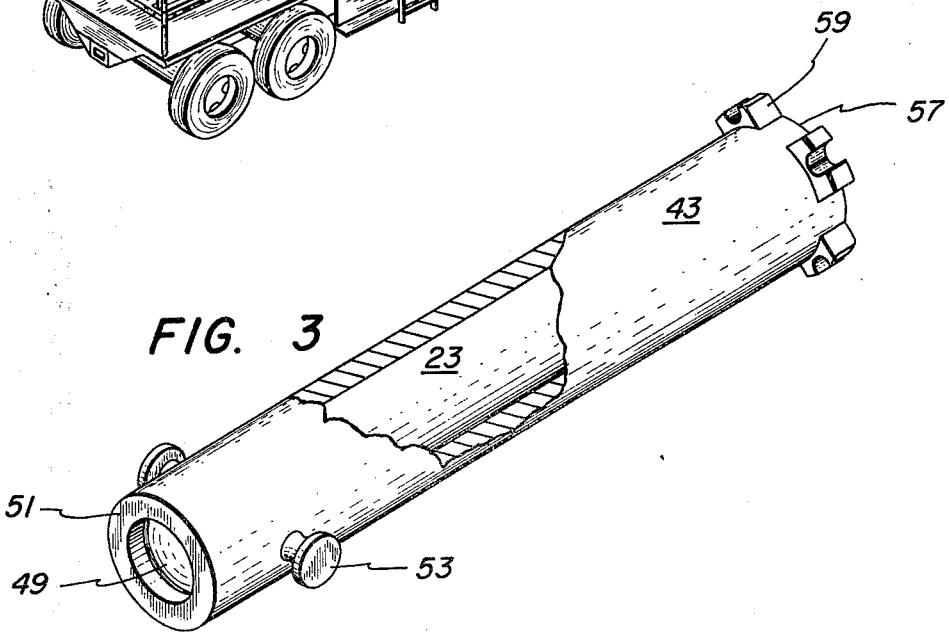
FIG. 3 is an isometric view of a mold having a stuck ingot therein.

In FIG. 1 of the drawings, reference numeral 1 generally refers to the invention of the self-contained, non-polluting, mobile ingot extractor comprising at one end a wheeled undercarriage, generally referred to be reference numeral 3, whose frame 5 carries and mounts the power unit, generally referred to by reference numeral 7; and longitudinal frame members 9 and 11 fixed to frame 5 at one end and fixed at their other ends to a drawbar frame 13, with a coupler or hitch 15 for operative connection to a suitable vehicle or prime mover for towing same.

The power unit 7 includes a propane tank 17 providing propane to thereby non-pollutingly operate and run the engine 19 which drives either the high volume-low pressure hydraulic pump to effect, optionally and valve controllably, fast-forward travel of the ram head 21 or fast return of the ram head 21, or drives the low volume-high pressure hydraulic pump to exert force through such ram head 21 upon the ingot 23 in the magnitude of 500 tons.

A cross-bracket 25, fixed to frame members 9 and 11, mounts the reciprocating, hydraulic ram 27 operatively connected to the hydraulic pumps. Another cross-bracket 29, adjustable along the longitudinal axes of frame members 9 and 11, carries stops 31 laterally movable on such cross-bracket 29. As shown, cross-bracket 29 is suitably bolted to frame members 9 and 11; and additional bolt holes are provided in frame members 9 and 11 to permit cross-brackets 29 to be adjusted to another position along the longitudinal axes of frame members 9 and 11, and be rebolted in such new position. A pintle 33, fixed to and vertically upstanding from cross-bracket 25, is pivotally received within a female boom 35 along whose track 37 an electric hoist 39 is movable with electrical power supplied to hoist 39 by an alternator driven by engine 19.

In operative use of the extractor 1, same is hauled or towed into the steel plant, unhitched and its front wheel 41 appropriately positioned to level the extractor 1. Cross-bracket 29 is appropriately positioned on frame members 9 and 11 to spatially accommodate the length of the molds 43 whose stuck ingots 23 are to be removed. A one-inch, or otherwise suitable, cross cut is made off the a bottom of the mold 43 leaving the remaining mold and ingot thereat flush. Mold 43 is so disposed by the steel-plant crane 45 such that the longitudinal axis of the mold 43 will be coaxial with the axis of the ram 27. Mold 43 is appropriately blocked into such position by cross blocks 47 for engagement of the ram head 21 with the ingot end 49 through the open or poured end 51 of mold 43 adjacent its trunnions 53. The bottom end 57 of mold 43 remaining after such described cross cut has been performed, is appropriately positioned so that its transversely projecting ears 59 will engage and abut the stops 31, and with such stops 31 having been laterally adjusted on cross-bracket 29 for non-interfering clearance of the ingot 23 removed therefrom and therebetween.

The high volume-low pressure, hydraulic pump is driven to effect fast-forward travel of the ram head 21 to engage the ingot end 49 followed by drive of the low volume-high pressure, hydraulic pump to exert force through such ram head 21 upon such ingot end 49 to the extent of such ram head's forward travel to thereby push such ingot 23 forward towards cross-bracket 29.

Next the high volume-low pressure hydraulic pump is driven in return phase to effect fast retraction of the ram head 21 to its inoperative or starting position. The female boom 35 and electric hoist 39 are appropriately manipulated and operated to pick up and dispose a spacer plug 61 within the open end 51 of mold 43 and in abutting relationship against the ingot end 49.

The high volume-low pressure, hydraulic pump is driven to effect fast-forward travel of the ram head 21 to engage such spacer plug 61, followed by drive of the low volume-high pressure, hydraulic pump to exert force through such ram head 21 upon such spacer plug 61 and hence upon such ingot end 49 to the extent of such ram head's forward travel to thereby push such ingot 23 forward in the direction of cross-bracket 29. The high volume-low pressure, hydraulic pump is driven in its return phase to effect fast retraction of the ram head 21 to its inoperative or starting position.

This described procedure is repeated as many times with as many spacer plugs 61 as may be necessary to extract and remove ingot 23 from mold 43.

The extractor 1 of this invention is over 40 feet in length. The procedure in removing a stuck ingot from its mold involves disposing the stuck ingot horizontally. If such procedure involved disposition of the stuck ingot vertically to effect its removal, a building 5 or more stories in height would be necessary and the extractor would be costly, cumbersome and would occupy permanent floor space in the steel plant for the reasons that substantial safety features would have to be incorporated to protect personnel from physical harm and injury once the stuck ingot has been freed from its mold, substantial framing support structure would have to be incorporated to dispose the extractor some 40 feet in the air, and, for all intents and purposes, such additional safety features and support structure would militate against the extractor's being mobile.

Having thusly described my invention, I claim:

1. A mobile ingot extractor for use in removing a stuck ingot from its mold, said mobile ingot extractor comprising a wheeled trailer having a frame, longitudinal frame members, a drawbar frame, coupling means, cross-members, stops, ram means, self-containment means and spacer plugs; said longitudinal frame members being carried at one of their common ends by said wheeled-trailer frame and at their other common ends by said drawbar frame, said drawbar frame carrying said coupling means, said coupling means operatively connecting said mobile ingot extractor to a prime mover means for towing and positioning said mobile ingot extractor, said longitudinal frame members carrying said cross-members, said cross-members carrying said stops and ram means, said cross-members being relatively adjustable therebetween along the longitudinal axes of said longitudinal frame members to spatially accommodate molds of different lengths, said mold being disposed between said stop means and ram means for operative engagement by said ram means with said stuck ingot of said mold, said stops being movable laterally and radially on one of said cross-members to spatially accommodate molds of different diameters, said ram means being operable for engagement with said stuck ingot for removal of same from its said mold, said self-containment means comprising an energy supply, engine means and hydraulic pump means, said energy supply operating and running said engine means, said engine means driving said hydraulic pump means, said hydraulic pump means reciprocably driving said ram means forward to engage and move said stuck ingot forward the extent of the forward travel of said ram means or driving said ram means to its inoperative or starting position, and spacer plugs for insertion into a mold received by said mobile ingot extractor, said mold successively receiving said spacer plugs to spatially accommodate the resulting spaces caused by forward movements of said ingot through said mold corresponding to the successive forward travels of said ram means.

2. A mobile ingot extractor in accordance with claim 1, wherein said ingot to be extracted from a mold is of special or exotic metal.

3. A mobile ingot extractor in accordance with claim 1, wherein said ingot has a uniform external diameter and said mold has a complemental internal diameter.

4. A mobile ingot extractor in accordance with claim 1, wherein are further provided an alternator means and electric hoist, wherein said engine means drives said alternator means, wherein said alternator means supplies power to said electric hoist, and wherein said electric hoist is operable to pick up and dispose said spacer plugs within said mold.

5. A mobile ingot extractor in accordance with claim 1, wherein said energy supply is non-polluting propane.

6. A mobile ingot extractor in accordance with claim 1, wherein said ingot to be extracted from a mold is of special or exotic metal, wherein said ingot has a uniform external diameter and said mold has a complemental internal diameter, wherein said energy supply is non-polluting propane, wherein are further provided an alternator means and electric hoist, wherein said engine means drives said alternator means, wherein said alternator means supplies power to said electric hoist, and wherein said electric hoist is operable to pick up and dispose said spacer plugs within said mold.

* * * * *